US006853833B2

(12) United States Patent
Cho et al.

(10) Patent No.: US 6,853,833 B2
(45) Date of Patent: Feb. 8, 2005

(54) FUSING DEVICE FOR AN ELECTROPHOTOGRAPHIC IMAGE FORMING APPARATUS

(75) Inventors: Durk-hyun Cho, Gyeonggi-do (KR); Kwang-young Chung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/624,897

(22) Filed: Jul. 23, 2003

(65) Prior Publication Data

US 2004/0131400 A1 Jul. 8, 2004

(30) Foreign Application Priority Data

Aug. 29, 2002 (KR) ..... 10-2002-0051485

(51) Int. Cl.[7] ..... G03G 15/20

(52) U.S. Cl. ..... 399/330; 219/216; 399/333; 432/60

(58) Field of Search ..... 399/328, 330, 399/333; 219/216, 469; 432/60

(56) References Cited

U.S. PATENT DOCUMENTS 6,628,917 B2 * 9/2003 Lee ..... 399/330
6,665,504 B2 * 12/2003 Lee et al. ..... 399/330
6,665,515 B2 * 12/2003 Lee ..... 399/330
6,690,907 B2 * 2/2004 Lee ..... 399/330

* cited by examiner

*Primary Examiner*—William J. Royer
(74) *Attorney, Agent, or Firm*—Staas & Halsey LLP

(57) ABSTRACT

A fusing device for an electrophotographic image forming apparatus includes a fusing roller which includes a tubular heat pipe, both ends of which are sealed and in which a predetermined amount of a working fluid is contained, a cylindrical roller which surrounds the heat pipe, and a heater which is installed between the cylindrical roller and the heat pipe, and a pressing roller which presses a sheet of paper passing between the pressing roller and the fusing roller. A rubber layer having a predetermined thickness is formed on a surface of the cylindrical roller so as to form a fusing nip with the paper.

20 Claims, 6 Drawing Sheets

FUSING DEVICE FOR AN ELECTROPHOTOGRAPHIC IMAGE FORMING APPARATUS

CROSS-REFERENCE TO RELATED APPLICATIONS

This application claims the priority of Korean Patent Application No. 2002-51485, filed on Aug. 29, 2002, in the Korean Intellectual Property Office, the disclosure of which is incorporated herein in its entirety by reference.

BACKGROUND OF THE INVENTION

1. Field of the Invention

The present invention relates to a fusing device for an electrophotographic image forming apparatus, and more particularly, to a fusing device for an electrophotographic image forming apparatus having a large-sized fusing roller which supplies fusing heat to a color or high-speed laser printer.

2. Description of the Related Art

In general, an electrophotographic printer includes a fusing device which heats a sheet of paper onto which a toner image is transferred, melts the toner image in a powder state on the paper, and fuses the melted toner image on the paper. The fusing device includes a fusing roller which fuses toner on the paper; and a pressing roller which pushes the paper against the fusing roller.

FIG. 1 is a schematic cross-sectional view of a conventional fusing roller 10 using a halogen lamp 12 as a heat source, and FIG. 2 is a schematic cross-sectional view of a conventional fusing device using the fusing roller 10 of FIG. 1. Referring to FIG. 1, the fusing roller 10 includes a cylindrical roller 11 and the halogen lamp 12 installed inside the cylindrical roller 11. A TEFLON coating layer 11*a* is formed on a circumference of the cylindrical roller 11. The cylindrical roller 11 is heated by radiant heat generated from the halogen lamp 12.

Referring to FIG. 2, a pressing roller 13 is placed under the fusing roller 10 to be opposite to the fusing roller 10, and a sheet of paper 14 is placed between the fusing roller 10 and the pressing roller 13. The pressing roller 13 is elastically supported by a spring 13*a* and closely presses the paper 14 passing between the fusing roller 10 and the pressing roller 13 toward the fusing roller 10 with a predetermined pressure. In this case, a toner image 14*a* formed on the paper 14 in a powder state is fused on the paper 14 due to the predetermined pressure and heat while the paper 14 passes between the fusing roller 10 and the pressing roller 13.

A thermistor 15 and a thermostat 16 are installed at one side of the fusing roller 10. The thermistor 15 measures a surface temperature of the fusing roller 10, and the thermostat 16 cuts off power supplied to the halogen lamp 12 when the surface temperature of the fusing roller 10 exceeds a predetermined value. The thermistor 15 measures the surface temperature of the fusing roller 10 and transmits an electrical signal corresponding to the measured surface temperature to a controller (not shown) of a printer (not shown). The controller controls the power supplied to the halogen lamp 12 according to the measured surface temperature and maintains the surface temperature of the fusing roller 10 within a given range. When the measured surface temperature of the fusing roller 10 exceeds the predetermined value because the controller fails in controlling the surface temperature of the fusing roller 10, a contact (not shown) of the thermostat 16 becomes open to cut off the supply of power to the halogen lamp 12.

Power consumption of a conventional fusing device using a halogen lamp as a heat source is large. In particular, the conventional fusing device requires a fairly long warming-up time when the power is turned on to the fusing device. In particular, in the conventional fusing device, the fusing roller is heated by the radiant heat generated from the heat source. Thus, a heat transfer is slow, and compensation for a difference in the surface temperature of the fusing roller due to a temperature decrease caused by contacting the paper is slow, so it is difficult to maintain the fusing roller at a predetermined temperature.

Accordingly, it is difficult to apply the conventional fusing device to a printer requiring a rapid fusing heat supply, such as a color laser printer or a black-and-white laser printer for high-speed printing of 25 sheets per minute.

In addition, when the conventional fusing device having the above structure is used in the color laser printer or a high-speed laser printer, a diameter of the fusing roller increases. As a result, a new structure is required to prevent a heat loss occurring at both ends of the fusing roller, and in order to improve a heat transfer onto the paper moving at a high-speed and having an overlapped toner image, a width of a fusing nip is needed to be increased.

SUMMARY OF THE INVENTION

The present invention provides a fusing device for an electrophotographic image forming apparatus that reduces a warming-up time using a heat pipe, reduces a heat loss occurring at both ends of a fusing roller, and easily forms a fusing nip.

Additional aspects and advantages of the invention will be set forth in part in the description which follows and, in part, will be obvious from the description, or may be learned by practice of the invention.

According to the above and/or other aspects of the present invention, a fusing device for an electrophotographic image forming apparatus includes a fusing roller which includes a tubular heat pipe, both ends of which are sealed and in which a predetermined amount of a working fluid is contained, a cylindrical roller which surrounds the heat pipe, and a heater which is installed between the cylindrical roller and the heat pipe, and a pressing roller which presses a sheet of paper passing between the pressing roller and the fusing roller. A rubber layer having a predetermined thickness is formed on a surface of the cylindrical roller so as to form a fusing nip with the paper.

According to another aspect of the present invention, the rubber layer is formed of silicon having a thickness of 1–3 mm.

A step is formed at both ends of the cylindrical roller, and the cylindrical roller includes a cylindrical part and two step parts connected to both ends of the cylindrical part, and one of the step parts and the cylindrical part are formed as a single body by swaging, and the other step part and the cylindrical part are screwed to each other.

Also, the cylindrical part and a corresponding one of the step parts are screwed to each other.

According to another aspect of the present invention, an outer diameter of the fusing roller is 35–50 mm.

According to another aspect of the present invention, the pressing roller includes a heater.

According to another aspect of the present invention, the pressing roller includes a tubular heat pipe, both ends of which are sealed and in which a predetermined amount of a working fluid is contained, and a cylindrical roller which surrounds the heat pipe.

Also, the pressing roller includes a cylindrical roller which surrounds the heater, and the heater is a halogen lamp.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
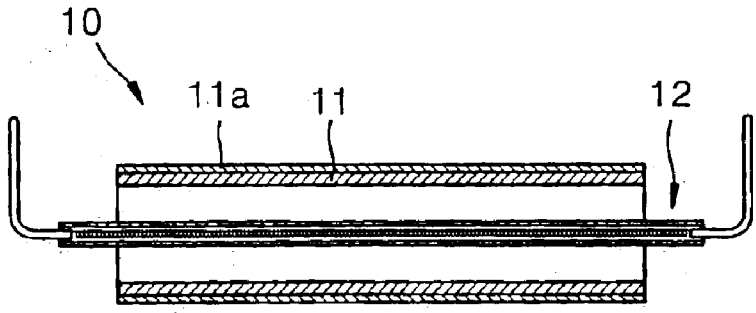
FIG. 1 (PRIOR ART)
FIG. 1 is a schematic profile cross-sectional view of a conventional fusing roller using a halogen lamp as a heat source.
Figure 2:
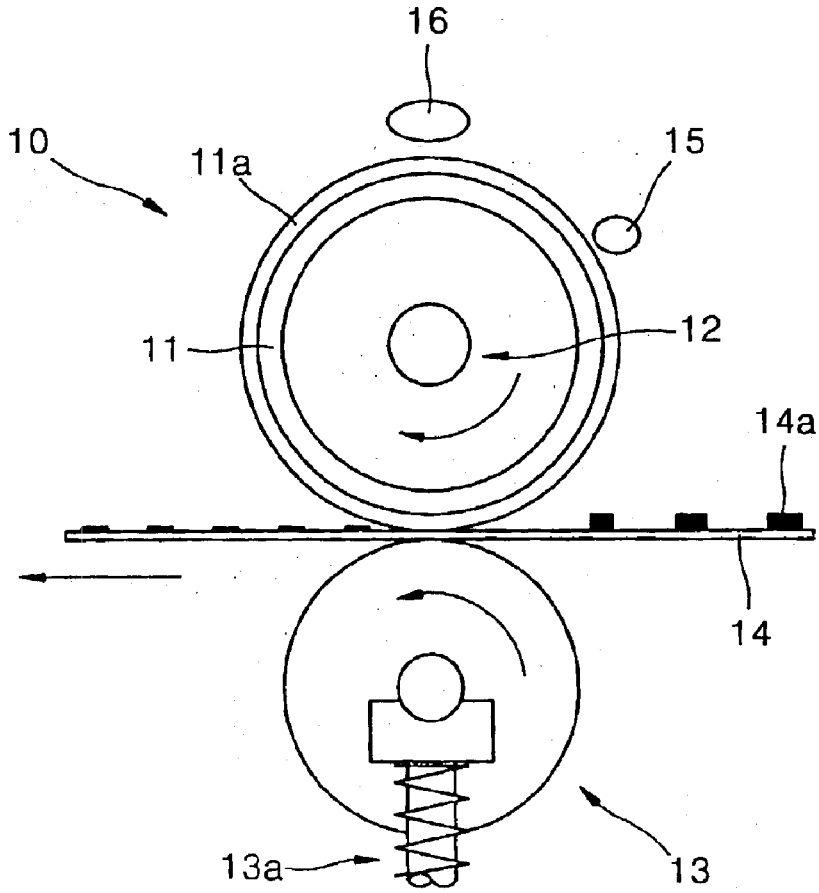
FIG. 2 (PRIOR ART)
FIG. 2 is a schematic frontal cross-sectional view of a conventional fusing device using the fusing roller of FIG. 1.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

Hereinafter, preferred embodiments of the present invention will be described in detail with reference to the accompanying drawings. Thicknesses of layers or regions shown in the drawings are exaggerated for clarity of a specification.

Figure 3:
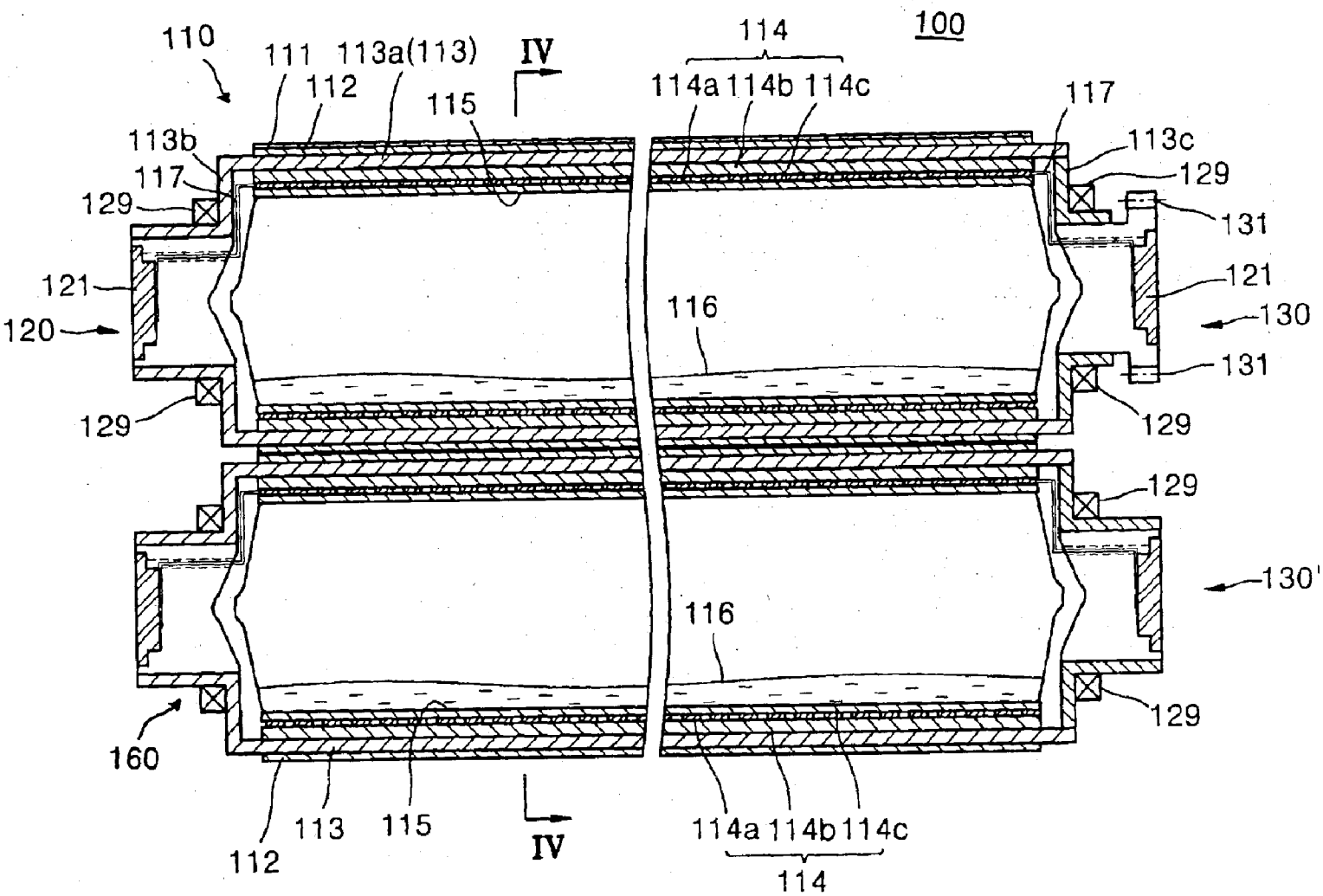
FIG. 3 is a schematic profile cross-sectional view of a fusing device for an electrophotographic image forming apparatus according to an embodiment of the present invention.
Figure 4:
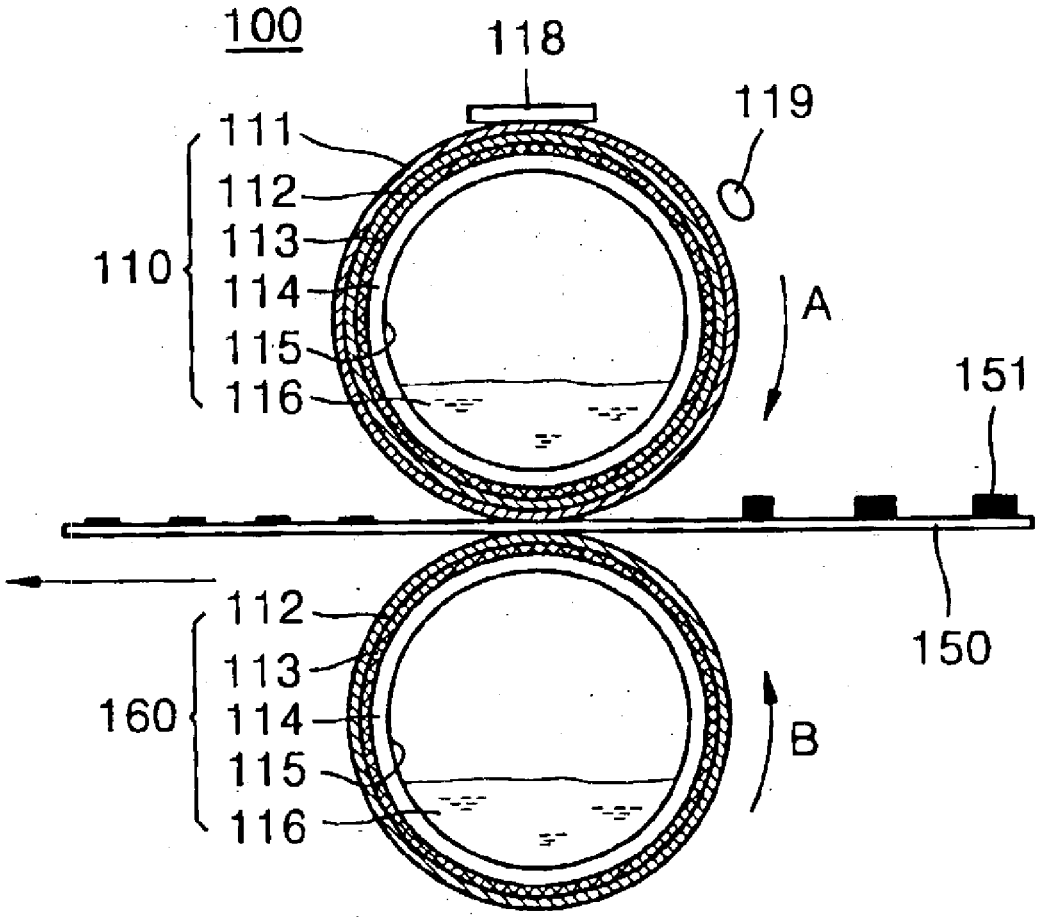
FIG. 4 is a cross-sectional view taken along line IV—IV of FIG. 3.

FIG. 3 is a schematic profile cross-sectional view of a fusing device 100 for an electrophotographic image forming apparatus according to an embodiment of the present invention, and FIG. 4 is a cross-sectional view taken along line IV—IV of FIG. 3. Referring to FIGS. 3 and 4, the fusing device 100 includes a fusing roller 110 having a cylindrical roller 113 which rotates in a direction in which a sheet of printer paper 150 having a toner image 151 thereon is ejected, i.e., in a direction indicated by an arrow A, and a pressing roller 160 which is installed to face the fusing roller 110 through the paper 150 therebetween and rotates in another direction indicated by an arrow B to be in contact with the fusing roller 110.

The cylindrical roller 113 includes a cylindrical part 113*a* and step parts 113*b* and 113*c* formed at both ends of the cylindrical part 113*a*. A silicon rubber layer 112 is formed at a thickness of 1.5 mm on a circumference of the cylindrical part 113*a*. A toner protective layer 111 is formed of TEFLON at a thickness of 20–30 $\mu$m on the silicon rubber layer 112. A heater 114 is disposed on an inner surface of the cylindrical roller 113, and a heat pipe 115, both ends of which are sealed, is disposed on an inner surface of the heater 114. A thickness of the silicon rubber layer 112 may vary according to a material of a surface of the pressing roller 160.

The step part 113*b*, connected to one end of the cylindrical part 113*a*, is swaged so that a step is formed inwardly. Thus, the step part 113*b* and the cylindrical part 113*a* are formed as a single body. Meanwhile, the step part 113*c* is connected to the other end of the cylindrical part 113*a* by a screw. That is, a female screw is formed at the other end of the cylindrical part 113*a*, and a male screw corresponding to the female screw is formed at the step part 113*c*. To fabricate the fusing roller 110, firstly the step part 113*c* is detached from the cylindrical roller 113, the heat pipe 115 and the heater 114 having a predetermined diameter are inserted into the cylindrical roller 113, and a pressure of 100–150 bar is applied inside the heat pipe 115 such that the heat pipe 115 is extended (expanded). Thus, the heater 114 is closely attached to an outer surface of the heat pipe 115 and an inner surface of the cylindrical roller 113. Next, the step part 113*c* can be screwed to the corresponding end of the cylindrical part 113*a*. Meanwhile, ball bearings 129 are disposed around the step parts 113*b* and 113*c* to support the fusing roller 110 having the step parts 113*b* and 113*c*.

Meanwhile, a thermistor 118 which measures a surface temperature of the fusing roller 110 is installed on the toner protective layer 111. Also, a thermostat 119 is installed at one side of the toner protective layer 111 and cuts off a power supplied to the heater 114 and prevents overheating when the surface temperature of the fusing roller 110 rapidly increases.

The heater 114 includes a Ni—Cr resistive coil 114*a* which generates heat by electricity supplied from an external power supply, magnesium oxide (MgO) layers 114*b* and 114*c* which surround the resistive coil 114*a*, and a lead 117 which supplies the electricity to the resistive coil 114*a* through both ends of the heater 114. A Cr—Fe coil may be used as the resistive coil 114*a*.

The heat pipe 115 is formed in a tube shape having both ends sealed. A predetermined amount of a working fluid 116 is contained in the heat pipe 115. The working fluid 116 is vaporized by the heat generated in the heater 114 and serves as a thermal medium which transfers the heat to the cylindrical roller 113, prevents a temperature deviation on the surface of the cylindrical roller 113, and heats an overall surface of the cylindrical roller 113 within a short period of time. The working fluid 116 takes a volume ratio of 5–50% with respect to a volume of the heat pipe 115, and the volume ratio of the working fluid 116 is 5–15% of the volume of the heat pipe 115. However, if the volume ratio of the working fluid 116 is less than 5%, a dry out is highly likely to occur.

The working fluid 116 is selectively used depending on a material of the heat pipe 115. That is, if the material of the heat pipe 115 is made of stainless steel, most known fluids excluding water may be used as the working fluid 116.

If the material of the heat pipe 115 is copper (Cu), most known fluids, i.e., water or distilled water, may be used as the working fluid 116. When the water or distilled water is used as the working fluid 116, costs for the working fluid 116 are reduced, and an environmental contamination does not occur.

A temperature of a surface of the silicon rubber layer 112 which directly contacts the paper 150 having the toner image 151 transferred through the toner protective layer 111, should be maintained at about 175° C. However, an inner surface of the silicon rubber layer 112 which contacts the cylindrical roller 113, is maintained at a maximum of 230–240° C. Thus, a silicon resistance at a high temperature is used in the silicon rubber layer 112. The silicon rubber layer 112 forms a fusing nip having a predetermined length, so as to aid fusing of the paper 150 which passes quickly in a high-speed laser printer. Also, the silicon rubber layer 112 aids fusing of overlapped toner images in a color laser printer.

The cylindrical roller 113 is heated by the heat of the heater 114 and by the vaporized heat generated from the working fluid 116 in the heat pipe 115. And the heat of the cylindrical roller 113 is transferred to the silicon rubber layer 112, and fuses the toner image 151 formed on the paper 150 in a powder state. The cylindrical roller 113 is formed of stainless steel, aluminum (Al), or copper (Cu).

First and second end caps 120 and 130 are inserted in both ends of the cylindrical roller 113. A structure of the second end cap 130 is almost the same as the first end cap 120 and is only different from the first end cap 130 in that a gear 131 is formed along an outer surface of the second end cap 130 and engaged With a gear (not shown) of a motor (not shown) to be rotated.

Figure 5A:
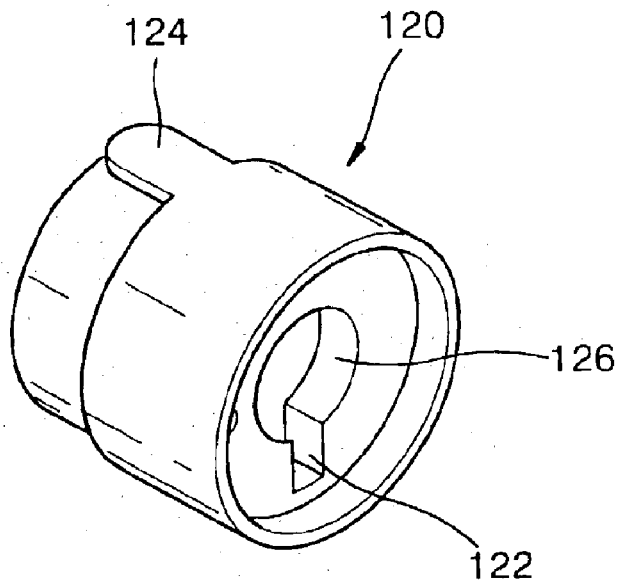
FIGS. 5A and 5B are perspective views of a first end cap of the fusing device shown in FIG. 3.
Figure 5B:
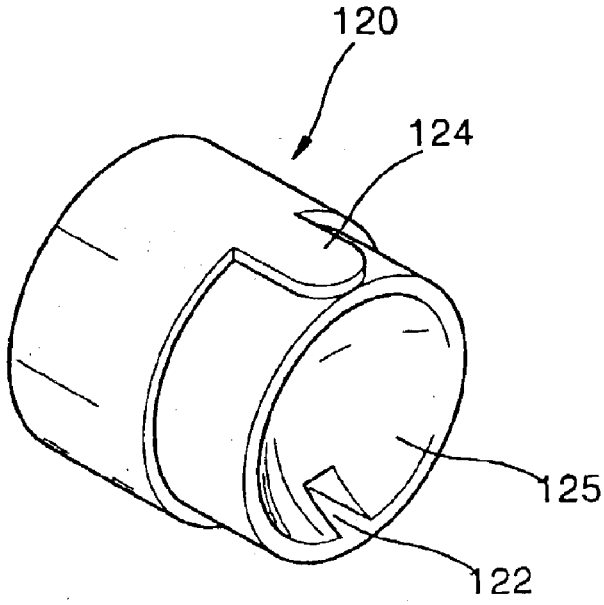
Figure 6A:
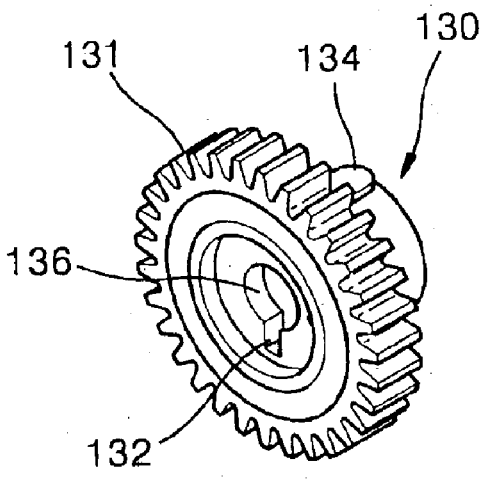
FIGS. 6A and 6B are perspective views of a second end cap of the fusing device shown in FIG. 3.
Figure 6B:
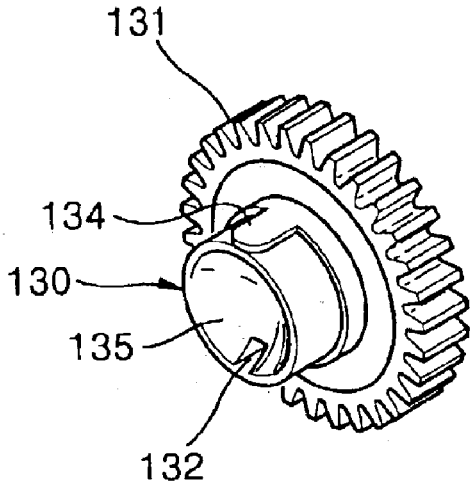

FIGS. 5A and 5B are perspective views of the first end cap 120 of FIG. 3, and FIGS. 6A and 6B are perspective views of the second end cap 130 of FIG. 3. Referring to FIGS. 5A through 6B, lead holes 122 and 132 through which a lead (117 of FIG. 3) is connected to an end of the resistive coil 114*a* are formed in the first and second end caps 120 and 130, respectively. Protrusion keys 124 and 134 are formed on a circumference of the first and second end caps 120 and 130 and engaged with a key groove (not shown) formed inside the step parts 113*b* and 113*c*, respectively. Concave parts 125 and 135, in which end portions of the heat pipe 115 are positioned, are formed inside the first and second end caps 120 and 130 to face the corresponding end portions of the heat pipe 115. Electrode grooves 126 and 136, in which an electrode 121 is inserted, are formed at a center of the first and second end caps 120 and 130 opposite to the concave parts 125 and 135. The electrode 121 supplies electricity to the lead 117 which passes through the lead holes 122 and 132.

The first and second end caps 120 and 130 may be made of resin, such as polyphenylene sulfide (PPS) in which a filler, such as glass fiber, having a small thermal deformation characteristic even at a high temperature, is inserted, poly butylenes terephthalate (PBT), or nylon.

Meanwhile, according to the present invention, the heater 114 is also provided in the pressing roller 160 to reduce a thermal load of the fusing roller 110. The same reference numerals as those of the fusing roller 110 are used in the pressing roller 160, and detailed descriptions thereof will be omitted.

Referring to FIGS. 3 and 4, the pressing roller 160 does not directly contact the toner image 151. Thus, the toner protective layer 111 is unnecessary, as in the fusing roller 110. Also, the pressing roller 160 is rotated by the fusing roller 110, there is no need to form a gear on another end cap 130'.

The pressing roller 160 having the above structure reduces the heat taken away from the fusing roller 110 to the paper 150 when the fusing roller 110 fuses the paper 150, and thus the pressing roller 160 is necessary in the high-speed laser printer and the color laser printer.

An operation of the fusing device 100 for the electrophotographic image forming apparatus having the above structure will be described in detail with reference to the accompanying drawings. The structures of the fusing roller 110 and the pressing roller 160 are similar. Thus, an operation of the fusing roller 110 will be described below.

If the electricity supplied from the external power supply is supplied to the lead 117 through the electrode 121, the electricity generates the heat in the resistive coil 114*a*. A portion of the heat is transferred to the cylindrical roller 113, and the other portion of the heat is transferred to the heat pipe 115. The working fluid 116 contained in the heat pipe 115 is heated by the heat and is vaporized, and the heat of the working fluid 116 in a gaseous state is transferred to the cylindrical roller 113 through the heater 114 installed on the surface of the heat pipe 115. The heat generated in the heater 114 and the heat generated from the working fluid 116 are transferred to the cylindrical roller 113 such that the temperature of the cylindrical roller 113 increases to about 230° C. The heat of the cylindrical roller 113 is transferred to the silicon rubber layer 112 such that the surface temperature of the fusing roller 110 reaches a target temperature required to fuse the toner image 151 in a powder state formed on the paper 150 within a short period of time.

Subsequently, in a printing mode, the toner image 151 in the powder state is transferred onto the paper 150, and the paper 150 passes between the fusing roller 110 and the pressing roller 160 maintained at a predetermined temperature, and the toner image 151 is fused on the paper 150 at a high speed in the fusing nip formed by the silicon rubber layers 112 formed on the surfaces of the fusing roller 110 and the pressing roller 160.

Meanwhile, as the fusing roller 110 and the pressing roller 160 fuse the paper 150 passing therebetween, the heat of the rollers 110 and 160 is taken to the paper 150, and the working fluid 116 inside the heat pipe 115 loses the heat and is liquefied. Then, the working fluid 116 to which the heat is transferred by the heater 114, is vaporized such that the surface temperature of the fusing roller 110 is maintained at the target temperature suitable for fusing the toner image 151 on the paper 150.

In general, a fusing temperature of the toner image 151 is about 160–190° C. The fusing device 100 according to another aspect of the present invention reaches the target temperature within about 10 seconds. The thermistor 118 measures the surface temperature of the fusing roller 110, and a controller (not shown) maintains the surface temperature of the fusing roller 110 within a predetermined range suitable for fusing the toner 151 on the paper 150. If an adjustment of the surface temperature fails and the surface temperature of the fusing roller 110 rapidly increases, the thermostat 119 cuts off power (electricity) supplied to the resistive coil 114*a* to prevent a rapid increase in the surface temperature of the fusing roller 110.

Figure 7:
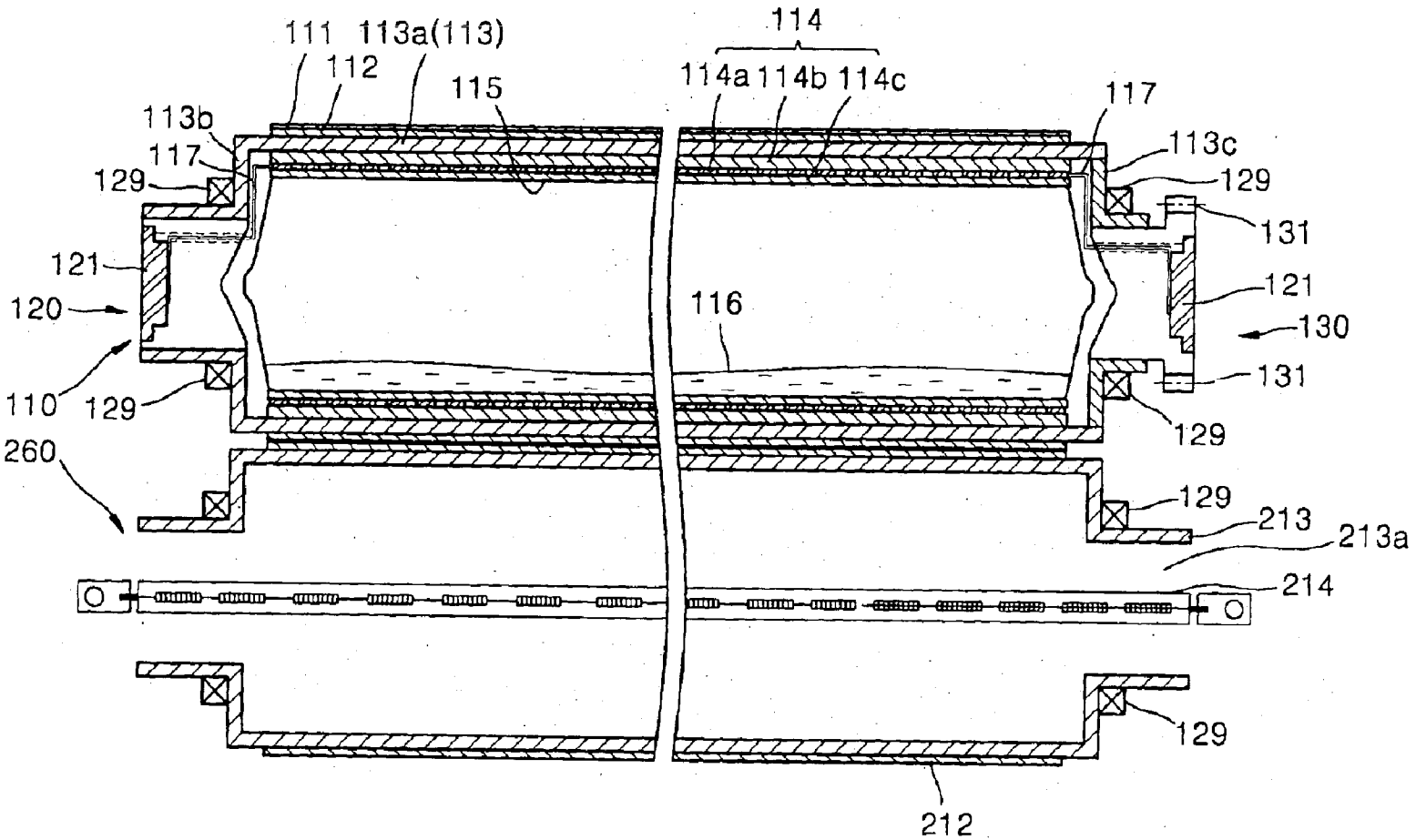
FIG. 7 is a schematic profile cross-sectional view of the fusing device for an electrophotographic image forming apparatus according to another embodiment of the present invention.

FIG. 7 is a schematic profile cross-sectional view of a fusing device for an electrophotographic image forming apparatus according to another embodiment of the present invention. Referring to FIG. 7, a fusing roller 10 is the same as the fusing roller 110 shown in FIGS. 3 and 4. But, a pressing roller 260 uses a halogen lamp 214 as a heating source. The pressing roller 260 includes a cylindrical roller 213 and the halogen lamp 214, which is the heating source in the cylindrical roller 213. Both ends of the cylindrical roller 213 are swaged such that an opening part 213*a* in which the halogen lamp 214 is inserted is formed at both ends of the cylindrical roller 213., According to another aspect of the present invention a silicon rubber layer 212 is formed on a surface of the cylindrical roller 213.

A warming-up time of the fusing device according to this embodiment of the present invention is a little longer than that of the fusing device 100 according to the first embodiment of the present invention, shown in FIGS. 3 and 4. But, the warming-up time of the fusing device is shorter than that of a conventional fusing device. Also, the structure of the pressing roller 260 is simplified, and manufacturing costs are reduced.

As described above, in the fusing device for an electrophotographic image forming apparatus according to the present invention, the warming-up time required for an initial driving is shortened using the heat pipe, and the fusing nip having a predetermined width is formed using a large-sized fusing roller having a diameter of 35–50 mm, such that the fusing device can be effectively used in the color laser printer and the high-speed laser printer.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. A fusing device for an electrophotographic image forming apparatus, the device comprising:

a fusing roller which includes a tubular heat pipe, a cylindrical roller which surrounds the heat pipe, and a heater which is installed between the cylindrical roller and the heat pipe; and a pressing roller which presses a sheet of paper passing between the pressing roller and the fusing roller;

wherein a rubber layer having a predetermined thickness is formed on a surface of the cylindrical roller so as to form a fusing nip with the paper.

2. The device of claim 1, wherein the rubber layer is formed of silicon.

3. The device of claim 1, wherein the thickness of the rubber layer is 1–3 mm inclusive.

4. The device of claim 1, wherein a step is formed at both ends of the cylindrical roller.

5. The device of claim 4, wherein the cylindrical roller comprises a cylindrical part and two step parts connected to both ends of the cylindrical part, and one step part and the cylindrical part are formed as a single body by swaging while the other step part and the cylindrical part are screwed to each other.

6. The device of claim 4, wherein the cylindrical roller comprises a cylindrical part and two step parts connected to both ends of the cylindrical part, and the cylindrical part and the step parts are screwed to each other.

7. The device of claim 1, wherein an outer diameter of the fusing roller is 35–50 mm inclusive.

8. The device of claim 1, wherein the pressing roller comprises:

a heater.

9. The device of claim 8, wherein the pressing roller comprises:

a tubular heat pipe, both ends of which are sealed and in which a predetermined amount of a working fluid is contained; and a cylindrical roller which surrounds the heat pipe.

10. The device of claim 8, wherein the pressing roller comprises a cylindrical roller which surrounds the heater, and the heater is a halogen lamp.

11. The device of claim 1, wherein both ends of the heat pipe are sealed and a predetermined amount of a working fluid is contained inside the heat pipe.

12. A fusing device for an electrophotographic image forming apparatus, the device comprising:

a fusing roller which includes a tubular heat pipe, a cylindrical roller which surrounds the heat pipe, and a heater which is installed between the cylindrical roller and the heat pipe and generates heat; and a pressing roller which presses a sheet of paper passing between the pressing roller and the fusing roller;

wherein a step is formed at both ends of the cylindrical roller.

13. The device of claim 12, wherein the fusing roller comprises:

a rubber layer having a predetermined thickness and formed on the surface of the cylindrical roller so as to form a fusing nip with the paper.

14. The device of claim 12, wherein the cylindrical roller comprises a cylindrical part and two step parts connected to both ends of the cylindrical part, and one step part and the cylindrical part are formed as a single body by swaging while the other step part and the cylindrical part are screwed to each other.

15. The device of claim 12, wherein the cylindrical roller comprises a cylindrical part and two step parts connected to both ends of the cylindrical part, and the cylindrical part and the step parts are screwed to each other.

16. The device of claim 12, wherein an outer diameter of the fusing roller is 35–50 mm inclusive.

17. The device of claim 12, wherein the pressing roller comprises:

a heater.

18. The device of claim 17, wherein the pressing roller comprises;

a tubular heat pipe, both ends of which are sealed, and in which a predetermined amount of a working fluid is contained; and a cylindrical roller which surrounds the heat pipe.

19. The device of claim 17, wherein the pressing roller comprises a cylindrical roller which surrounds the heater, and the heater is a halogen lamp.

20. The device of claim 12, wherein both ends of the heat pipe are sealed and a predetermined amount of a working fluid is contained inside the heat pipe.

* * * * *